US006701630B2

(12) United States Patent
Humphrey

(10) Patent No.: US 6,701,630 B2
(45) Date of Patent: Mar. 9, 2004

(54) POWER SHOVEL

(76) Inventor: Larry D. Humphrey, 890 PR 5937, Emory, TX (US) 75440

( * ) Notice: Subject to any disclaimer, the term of this patent is extended or adjusted under 35 U.S.C. 154(b) by 0 days.

(21) Appl. No.: 10/124,635

(22) Filed: Jul. 22, 2002

(65) Prior Publication Data

US 2004/0010948 A1 Jan. 22, 2004

(51) Int. Cl.[7] ..... E02F 3/96

(52) U.S. Cl. ..... 37/403; 37/468; 37/404; 37/903; 414/724

(58) Field of Search ..... 37/403, 468, 404, 37/407, 408, 409, 410, 379, 903; 414/724, 912

(56) References Cited

U.S. PATENT DOCUMENTS

| | | | | | |
|---|---|---|---|---|---|
| 721,230 | A | | 2/1903 | Pinion | 37/367 |
| 2,590,352 | A | | 3/1952 | Sanner et al. | 37/98 |
| 2,770,076 | A | | 11/1956 | Kluckhohn | 47/58 |
| 2,783,558 | A | * | 3/1957 | Morgan | 37/403 |
| 2,840,932 | A | | 7/1958 | Breyer | 37/145 |
| 3,039,210 | A | | 6/1962 | Slaughter | 37/117.5 |
| 3,512,276 | A | | 5/1970 | Juhl | 37/2 |
| 3,635,133 | A | * | 1/1972 | Stougaard | 404/133.2 |
| 3,774,686 | A | | 11/1973 | Michener | 172/26.5 |
| 3,795,331 | A | * | 3/1974 | Guest | 414/697 |
| 4,172,687 | A | * | 10/1979 | Schultz | 414/724 |
| 4,242,035 | A | * | 12/1980 | Hornstein | 414/724 |
| 4,360,980 | A | | 11/1982 | Jarvis | 37/117.5 |
| 4,521,980 | A | | 6/1985 | Solaja | 37/117.5 |
| 4,692,089 | A | * | 9/1987 | Rodgers et al. | 414/724 |
| 4,903,418 | A | | 2/1990 | Loudon | 37/2 R |
| 5,142,799 | A | | 9/1992 | Wood | 37/117.5 |
| D335,131 | S | | 4/1993 | Devaney | D15/32 |
| 5,253,449 | A | * | 10/1993 | Webb et al. | 37/446 |
| 5,273,375 | A | | 12/1993 | Plourde | 404/118 |
| 5,315,772 | A | * | 5/1994 | Lalonde | 37/379 |
| 5,615,499 | A | | 4/1997 | McGuire et al. | 37/367 |
| 5,833,008 | A | | 11/1998 | Reed et al. | 171/141 |
| 5,918,389 | A | | 7/1999 | Hall | 37/407 |
| 5,943,798 | A | | 8/1999 | McGuire et al. | 37/367 |
| 6,035,562 | A | | 3/2000 | Virnig et al. | 37/302 |
| 6,067,733 | A | | 5/2000 | Gasper | 37/367 |
| 6,085,447 | A | | 7/2000 | Rose | 37/403 |
| 6,088,938 | A | * | 7/2000 | Logan | 37/468 |
| 6,088,939 | A | * | 7/2000 | Logan | 37/468 |
| 6,308,440 | B1 | | 10/2001 | Mueller | 37/404 |
| 6,493,967 | B2 | * | 12/2002 | Holmes et al. | 37/468 |

* cited by examiner

*Primary Examiner*—Thomas B. Will
*Assistant Examiner*—Thomas A. Beach
(74) *Attorney, Agent, or Firm*—Thompson & Gustavson, L.L.P.

(57) ABSTRACT

A power shovel (10) for use on a bucket (14) of a front end loader (12) includes no modifications are required to the bucket (14) other than several bolt holes to mount the upper support bracket (24) of the power shovel. Alternatively, the upper support bracket (24) may be welded directly to the upper portion of the bucket (14) without drilling holes for bolts. The power shovel (10) includes a lower support bracket (22) fit over the blade (16) of the bucket (14) and an upper support bracket (24) bolted onto the top of the bucket (14). Chains (26, 28) are tensioned between the lower and upper support brackets around the back of the bucket( 14) to secure the lower support bracket (22) on the bucket (14). A digging portion (20) is welded to the lower support bracket (22) and further supported by support arms (30, 32) extending between the upper support bracket (24) and the digging portion (20).

13 Claims, 6 Drawing Sheets

POWER SHOVEL

BACKGROUND OF THE INVENTION

A front end loader with a bucket thereon is used in many applications. For example, the front end loader can be used to dig a trench, uproot trees, grade a surface and many other uses. However, the configuration of the typical bucket, having a broad front edge blade, limits the usefulness of the front end loader. The need exists to enhance the capabilities of the front end loader while maintaining standard functionality.

SUMMARY OF THE INVENTION

In accordance with one aspect of the present invention, an attachment is provided for a front end loader bucket. The bucket has a linear blade and a top. The attachment includes a lower support bracket fit over the blade of the bucket and an upper support bracket mounted to the top of the bucket. At least one chain is secured to the lower support bracket at a first end thereof and to the upper support bracket at an opposite end thereof. A digging portion having an inner end and an outer end is secured to the lower support bracket at the inner end. First and second support arms are mounted between the upper support bracket and the digging portion.

BRIEF DESCRIPTION OF THE DRAWINGS

For a more complete understanding of the present invention and the advantages thereof, reference is now made to the following Detailed Description, taken in conjunction with the accompanying Drawings, in which.

DETAILED DESCRIPTION

Figure 1:
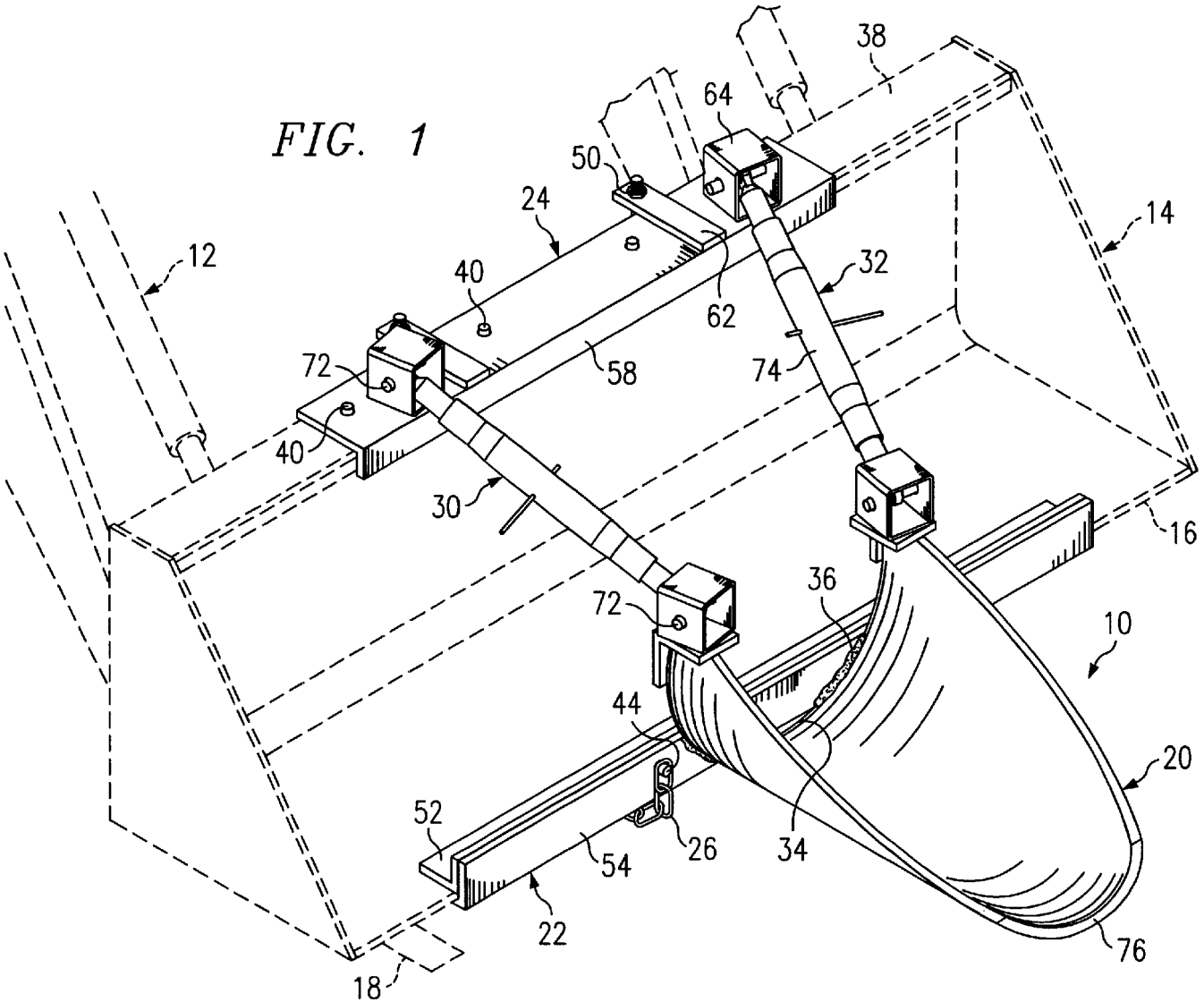
FIG. 1 is a perspective view of a power shovel forming a first embodiment of the present invention mounted on a bucket of a front end loader.
Figure 2:
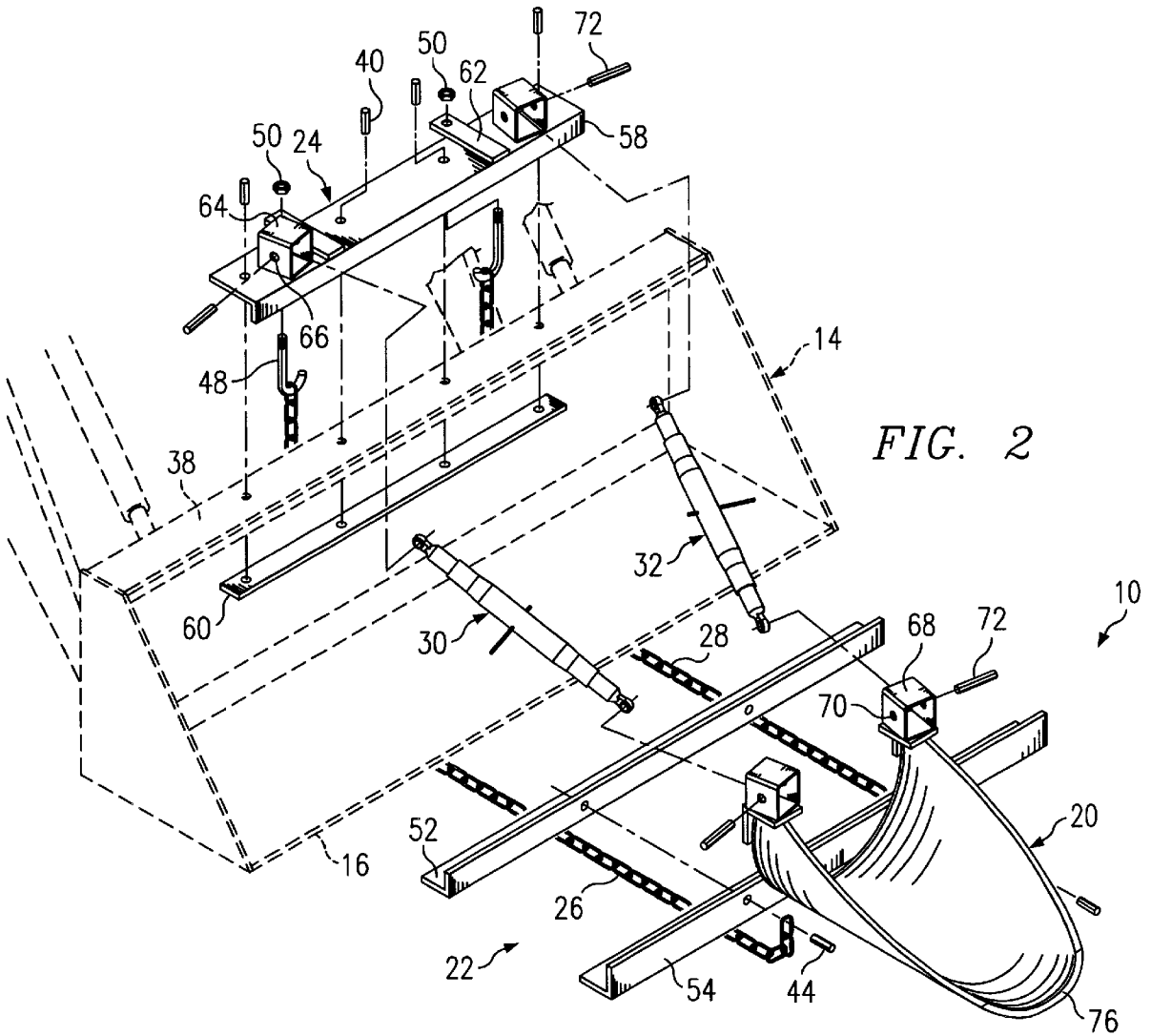
FIG. 2 is an exploded view of the power shovel.
Figure 3:
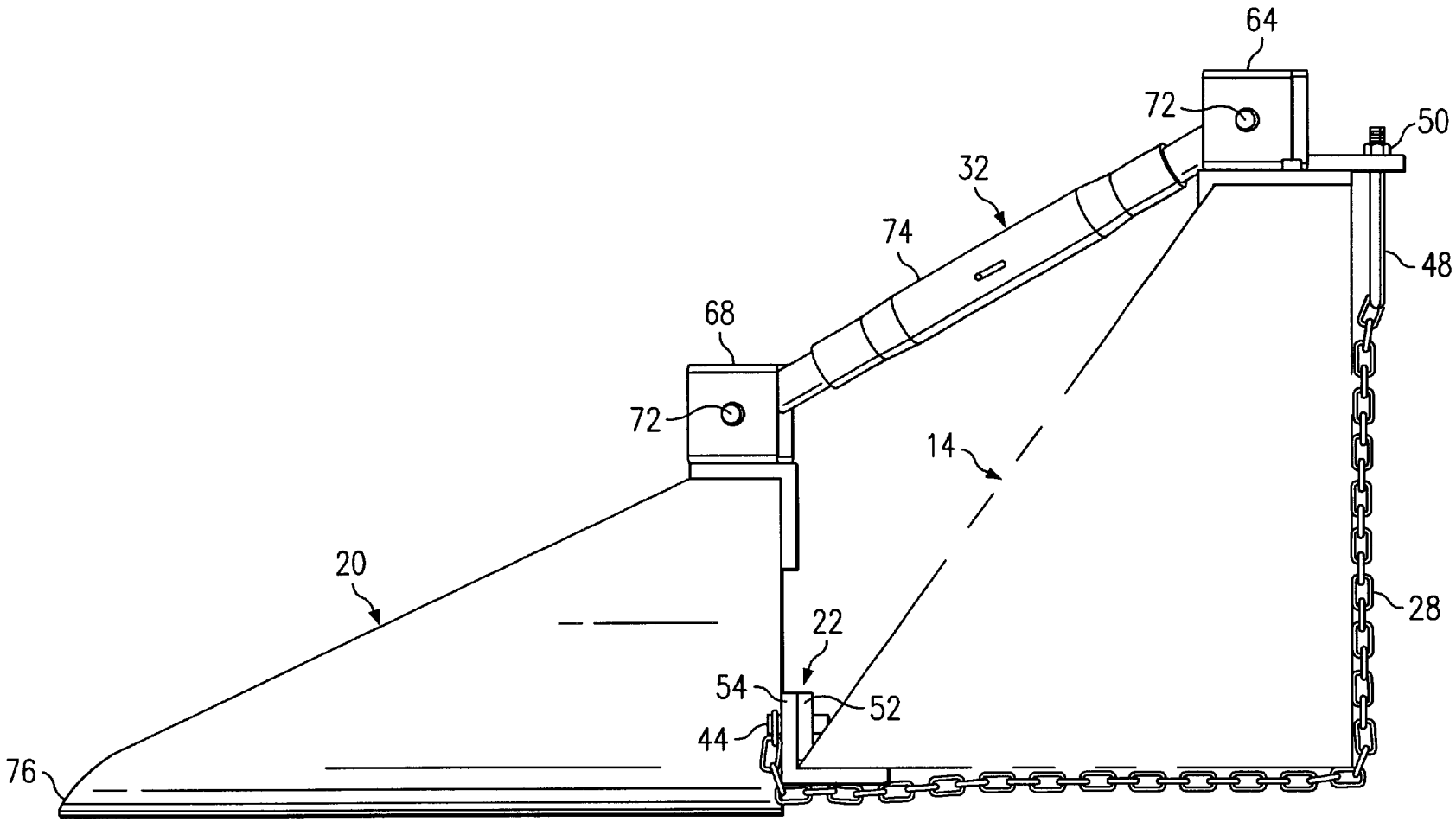
FIG. 3 is a side view of the power shovel mounted on the bucket.
Figure 4:
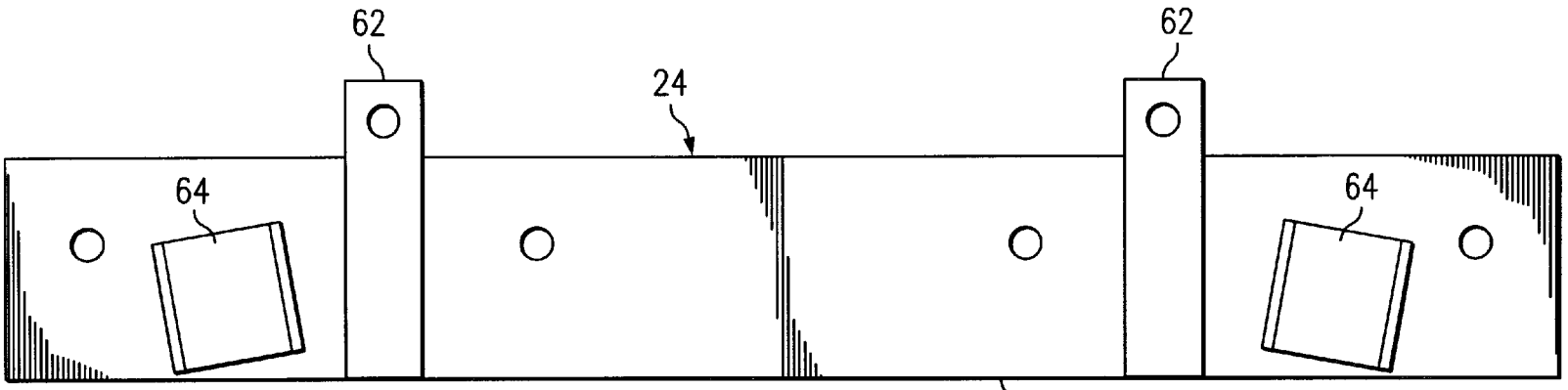
FIG. 4 is a top view of the upper support bracket.
Figure 5:
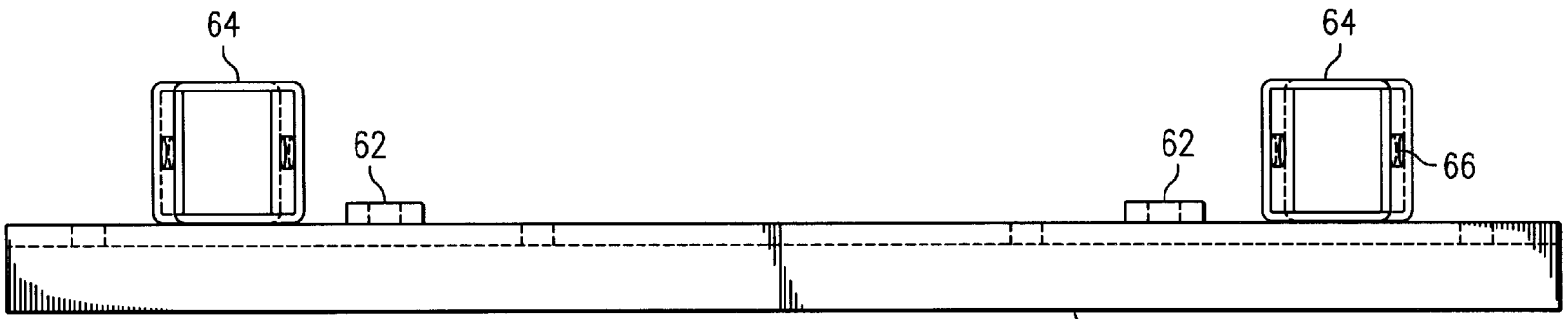
FIG. 5 is a front view of the upper support bracket.
Figure 6:
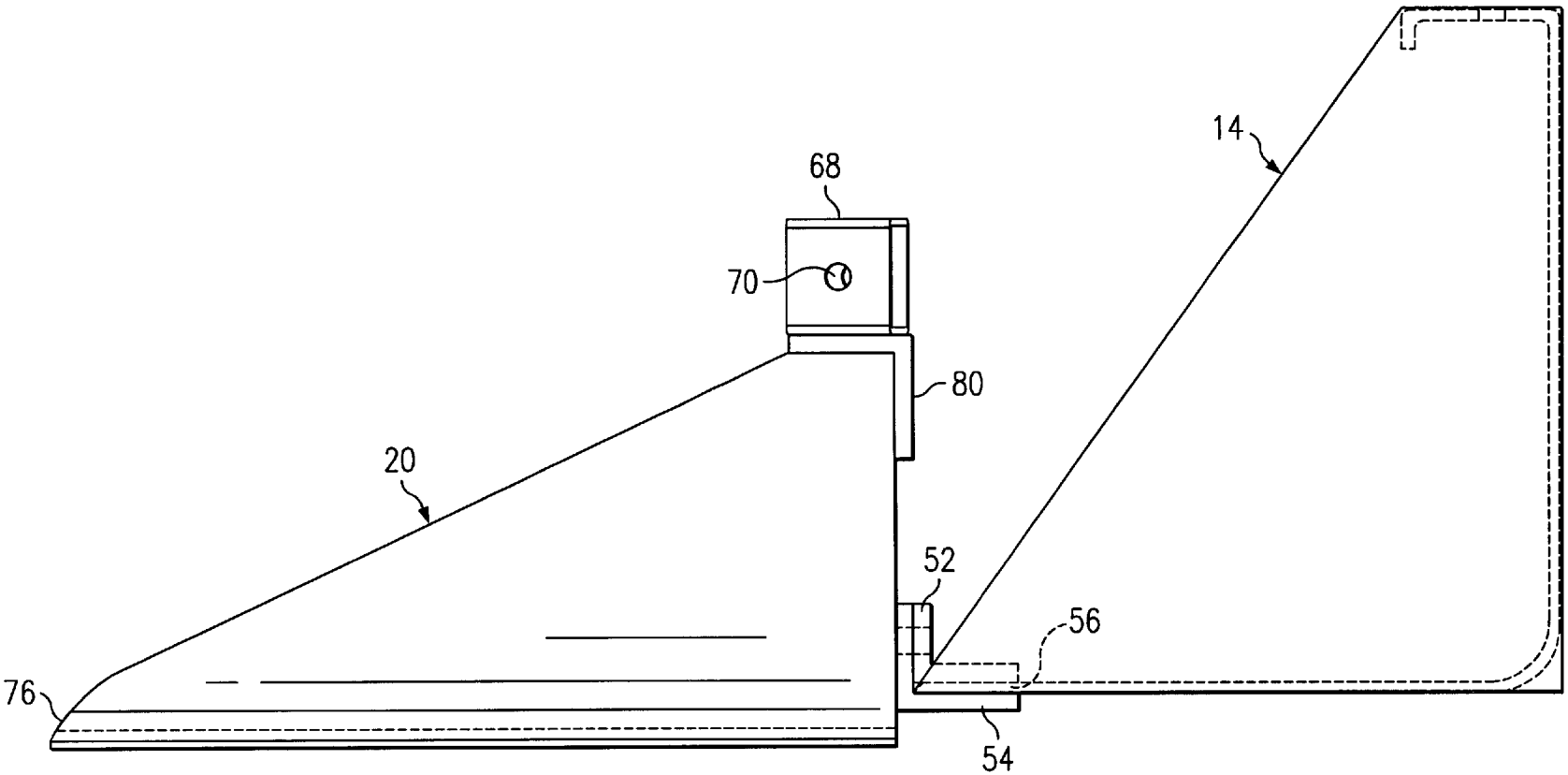
FIG. 6 is a side view of the digging portion.
Figure 7:
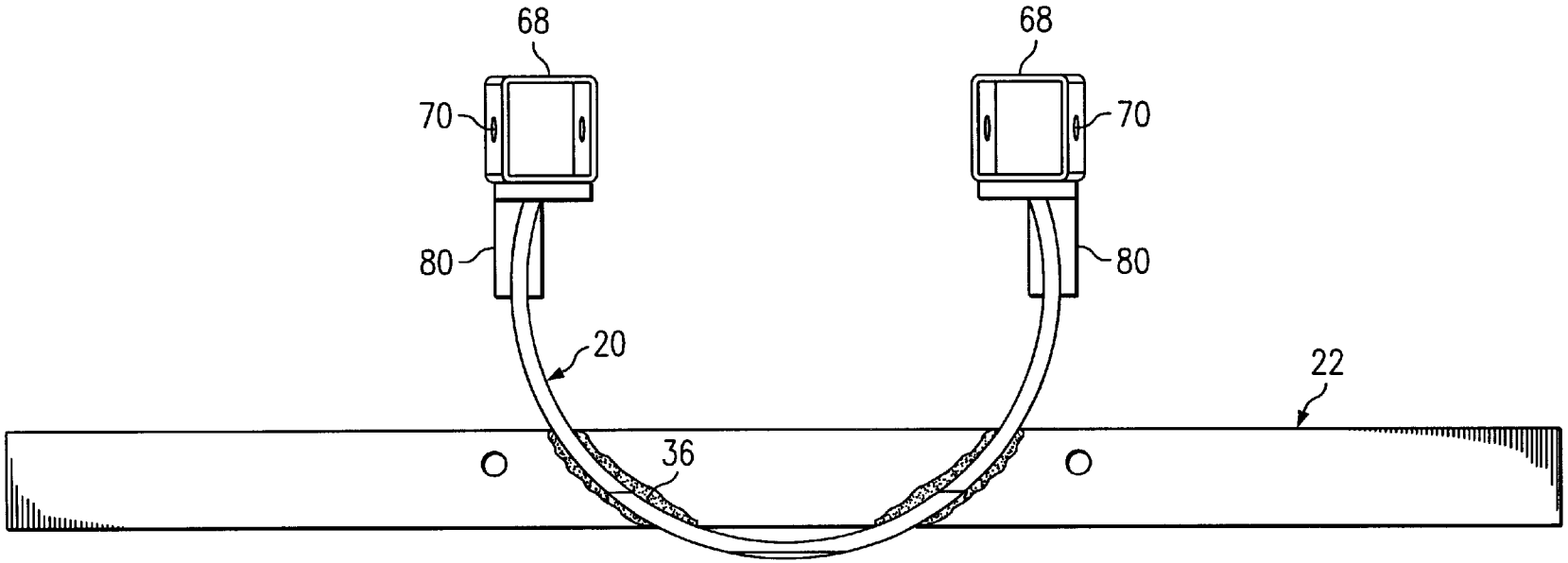
FIG. 7 is a front view of the digging portion and lower support bracket.

With reference now to the drawings, a power shovel 10 forming a first embodiment of the present invention will be described. The power shovel 10 is an attachment to the bucket 14 of a front end loader 12. The bucket 14 is of the standard configuration with a linear blade 16. The blade 16 may or may not have teeth 18.

The power shovel 10 includes a digging portion 20, a lower support bracket 22, an upper support bracket 24, a first chain 26, a second chain 28, a first support arm 30 and a second support arm 32. The lower support bracket 22 fits over the blade 16 of the bucket 14 in a manner to be described in greater detail hereinafter. The inner end 34 of the digging portion 20 is secured to the lower support bracket 22, as by weld 36. The upper support bracket 24 is mounted to the top 38 of the bucket 14 by any suitable mechanism. As shown, the upper support bracket 24 is bolted to the top 38 with four bolts 40 and suitable nuts. This would, of course, require four holes to be drilled in the top 38 of the bucket 14, but these holes would not impair the normal function of the bucket 14. Alternatively, or in addition, the upper support bracket could be welded to the bucket 14. The first chain 26 is attached by a bolt 44 to the lower support bracket 22 at a first end and extends around the back and top 38 of the bucket for attachment to the upper support bracket 24 at J-bolt 48. The second chain 28 is similarly secured by a bolt 44 to the lower support bracket 22 and extends around the back and top 38 of the bucket 14 for attachment to the upper support bracket 24 by a J-bolt 48. The nuts 50 securing the J-bolts 48 to the upper support bracket 24 can be tightened or loosened to tension the chains 26 and 28 to an appropriate degree. Sufficient tension is applied by the chains 26 and 28 to securely mount the lower support bracket 22 on the blade 16 of the bucket 14. The first and second support arms 30 and 32 are mounted between the upper support bracket 24 and either side of the digging portion 20 to further support the digging portion 20.

The lower support bracket 22 is preferably formed of a nested inner angle bracket 52 and outer angle bracket 54. The brackets 52 and 54 are nested to define a gap 56 to receive the front of blade 16 as the lower support bracket 22 is fit over the blade. The brackets 52 and 54 are held in the nested configuration by the bolts 44. In addition, the brackets 52 and 54 can be welded together. The upper support bracket 24 is formed by angle iron 58 and reinforcing strap 60 secured to the top 38 of the bucket 14 by bolts 40. The strap 60 is positioned inside the bucket 14 to reinforce the attachment of the upper support bracket 24 to the bucket 14. The upper support bracket 24 mounts plates 62 to which the J-bolts 48 are bolted. Upper support bracket 24 also mounts channel mounts 64 having aligned holes 66 through their sides to mount one end of the support arms 30 and 32. The digging portion 20 similarly mounts channel mounts 68 on either side thereof having aligned holes 70 to receive the other end of the support arms 30 and 32. A piece of angle iron 80 is preferably welded on the top and inner end 34 on each side of the digging portion 20 to mount channel mounts 68. The first and second support arms 30 and 32 are preferably adjustable length links of the type used in the center portion of a normal three point hitch on types of farm equipment. Each end of the support arms 30 and 32 has a movable joint with a passage to receive a bolt 72 to mount the ends to one of the channel mounts 64 and 68. The length of the support arms 30 and 32 can be adjusted by rotating barrel member 74 to shorten or lengthen the arm.

The outer end 76 of the digging portion 20 is preferably sharpened to more easily penetrate the ground. As can be understood, the front end loader 12 and bucket 14 can be manipulated to operate the power shovel 10 for many purposes. For example, the power shovel 10 can be used to fill the bucket 14 with dirt by tilting the power shovel 10 into the ground while moving the front end loader 12 forward to drive dirt through the digging portion 20 into the bucket 14. The power shovel 10 can be used for transplanting trees, ditching and digging. Also, the power shovel 10 can be used to control pouring of concrete or other materials, either liquid or solid, by using the digging portion 20 as a pouring spout. The power shovel has the ability to penetrate and load hard earth or other material. After the digging portion has been filled, the bucket can be raised and tilted to allow the bucket to be filled. Because the typical front end loader is designed to load and transport loose or soft material, it is not effective to dig or load hard earth or other such materials. The cutting edge of the blade 14 is normally at least three to six feet in length and this length makes it difficult to penetrate and load hard earth or other material. The power shovel 10 is designed to allow the shovel to be lowered into the ground while the front end loader moves forward, slowly filling the front end loader bucket 14. The power shovel 10 can also fill the front end loader bucket 14 by keeping the tractor in one spot by lowering the power shovel 10 into the ground, filling the shovel and raising the front end loader bucket 14 while tilting the bucket and dumping the shovel contents into the bucket 14. The upper support bracket 24 and lower support bracket 22 can also be used to mount other implements than the digging portion 20. For example, the brackets can mount a platform bale carrier, boom pole, round bale probe for transporting round hay bales, a pallet fork, a sod removal attachment, and any other equipment designed to be mounted on the brackets.

The digging portion 20 is preferably a curved piece of steel approximately two feet long and ¼ inch thick. The digging portion 20 can be bolted to lower support bracket 22 instead of or in addition to weld 36. The radius of the digging portion 20 is preferably about 16 inches. The angle iron 58 is preferably 3 inches by 3 inches by 36 inches long and has four ½ in. diameter bolt holes spaced equally apart. The strap 60 is preferably steel flat bar 1½ inches wide by ¼ inch thick by 36 inches long. The plates 62 are preferably 2½ in. by ⅜ in. by 6 in. flat steel with a ¼ in. diameter hole. The channel mounts 64 and 68 are preferably 3 in. tall by 3 in. wide by 3½ inch long, with a ¾ in. diameter hole 66 or 70, and are preferably of tube steel. The lower support bracket 22 is preferably formed of a 3 in. by 3 in. by 3 ft. long angle iron forming bracket 52 and a 2 in. by 2 in. by 3 ft. long angle iron forming bracket 54. Two ½ in. diameter holes are drilled in the angle brackets 52 and 54 to receive the bolts 44. The chains 26 and 28 are preferably about 4 ft. long. The support arms 30 and 32 are preferably adjustable between about a 12 inch length and a 16 inch length. The power shovel 10 can be made for small, medium and large tractors and will vary in size and length accordingly.

One advantage of power shovel 10 is that it can be used to fill the bucket 14 with material, such as dirt or sod. The power shovel 10 is driven into the material to be loaded, such as hard packed soil, such that the material is driven up the digging portion 20 into the bucket. It may be possible to completely fill the bucket 14 in this manner. However, if the material does not flow evenly into the bucket, it may be necessary to tilt the bucket upward to allow the material to redistribute itself evenly in the bucket before again lowering the bucket and engaging the material with the digging portion 20 to drive additional material up the digging portion 20 and into the bucket. It may take several upward tilts of the bucket in this manner to completely fill the bucket.

While one embodiment of the invention has been illustrated in the accompanying drawings and described in the foregoing detailed description, it will be understood that the invention is not limited to the embodiment disclosed, it is capable of numerous rearrangements, modifications and substitutions of parts and elements without departing from the spirit and scope of the invention.

What is claimed is:

1. An apparatus forming an attachment for a front end loader bucket, the bucket having a linear blade and a top, conmprising:

a lower support bracket fit over the blade of the bucket;

an upper support bracket mounted to the top of the bucket;

at least one chain secured to the lower support bracket at a first end and to the upper support bracket at an opposite end;

a digging portion having an inner end and an outer end having a digging edge, an outer end, the inner end secured to the lower support bracket, the digging edge extending in the direction of the blade of the bucket;

first and second support arms mounted between the upper support bracket and digging portion.

2. The apparatus of claim 1 wherein the digging portion has an elongate axis, the digging portion being curved in a plane perpendicular the elongate axis.

3. The apparatus of claim 1 wherein the support arms have a length, the length being variable.

4. The apparatus of claim 1 wherein the upper support bracket mounts a J-bolt, said chain being secured to said J-bolt, the J-bolt adjusting the tension in the chain.

5. The apparatus of claim 1 having first and second chains secured to the lower support bracket at a first end and at an opposite end to be upper support bracket.

6. The apparatus of claim 1 wherein the lower support bracket defines a slot, the slot receiving a portion of the blade as the lower support bracket is fit over the blade of the bucket.

7. The apparatus of claim 1 wherein the digging portion is welded to the lower support bracket.

8. The apparatus of claim 1 wherein the entire digging portion is in front of the blade.

9. The apparatus of claim 1, wherein the digging edge is substintially co-planar with the blade of the bucket to form an extension of the blade.

10. The apparatus of claim 1 wherein the digging portion has a conveying surface to convey material directly into the bucket.

11. A method for filling the bucket of a front end loader, the bucket having a blade and a top, comprising the steps of:

engaging material to be loaded in the bucket with a digging portion having an inner end and an outer end, the inner end secured to a lower support bracket fit over the blade of the bucket, an upper support bracket mounted to the top of the bucket, at least one chain secured to the lower support bracket at a first end and to the upper support bracket at an opposite end, first and second support arms mounted between the upper support bracket and digging portion;

driving the material along the digging portion into the bucket to fill the bucket.

12. The method of claim 11 further comprising the step of lifting the bucket to distribute material in the bucket loaded through the digging portion and subsequently again engaging material to be loaded in the bucket with the digging portion and driving additional material along the digging portion into the bucket to further fill the bucket.

13. The method of claim 11 wherein the step of driving material along the digging portion into the bucket includes a step of moving the front end loader forward while the digging portion engages the material to be loaded.

* * * * *